US007264496B2

(12) United States Patent
Wu

(10) Patent No.: US 7,264,496 B2
(45) Date of Patent: Sep. 4, 2007

(54) CABLE ASSEMBLY HAVING LOCKING MEMBER ON OPPOSITE SIDES THEREOF

(75) Inventor: Jerry Wu, Irvine, CA (US)

(73) Assignee: Hon Hai Precision Ind. Co., Ltd., Taipei Hsien (TW), .

( * ) Notice: Subject to any disclaimer, the term of this patent is extended or adjusted under 35 U.S.C. 154(b) by 0 days.

(21) Appl. No.: 11/480,039

(22) Filed: Jun. 29, 2006

(65) Prior Publication Data

US 2006/0246764 A1 Nov. 2, 2006

Related U.S. Application Data

(63) Continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/358

(58) Field of Classification Search ..... 439/351, 439/352, 353, 354, 355, 356, 357, 358
See application file for complete search history.

(56) References Cited

U.S. PATENT DOCUMENTS

| | | | | |
|---|---|---|---|---|
| 5,080,603 | A * | 1/1992 | Mouissie | 439/353 |
| 5,213,533 | A | 5/1993 | Walden | |
| 5,538,437 | A * | 7/1996 | Bates et al. | 439/352 |
| 5,727,963 | A | 3/1998 | Lemaster | |
| 5,775,931 | A | 7/1998 | Jones | |
| 5,860,826 | A | 1/1999 | Chang | |
| 5,941,726 | A | 8/1999 | Koegel et al. | |
| 6,099,339 | A | 8/2000 | Yanagida et al. | |
| 6,210,202 | B1 | 4/2001 | Kuo | |
| 6,361,348 | B1 * | 3/2002 | Hall et al. | 439/352 |
| 6,558,183 | B1 | 5/2003 | Ji et al. | |
| 6,565,383 | B1 | 5/2003 | Wu | |
| 6,585,536 | B1 | 7/2003 | Wu | |
| 6,585,537 | B1 | 7/2003 | Lee | |
| 6,786,755 | B2 | 9/2004 | Dambach et al. | |
| 6,951,474 | B1 * | 10/2005 | Wu | 439/358 |

* cited by examiner

*Primary Examiner*—Chandrika Prasad
(74) *Attorney, Agent, or Firm*—Wei Te Chung

(57) ABSTRACT

A cable assembly (1) mating with a complementary connector along a front-to-back direction comprises an insulative housing (10), a plurality of contacts (20) disposed in the housing, a plurality of downwardly extending cables (40) connected to the contacts, a cover (50) and a pair of locking member (60). The housing defines a pair of first retention cavities; The cover comprises a front and a rear covers (51, 52) assembled on the housing along the front-to-back direction, and enclosing front portions of the cables together, and defines a pair of downwardly extending U-shaped second retention cavities (55) therein, respectively, the first retention cavities aligned with the corresponding second retention cavities in a up-to-down direction perpendicular to the front-to-back direction; The locking members are received in the second retention cavities of the covers and extending into the first retention cavities of the housing.

20 Claims, 15 Drawing Sheets

CABLE ASSEMBLY HAVING LOCKING MEMBER ON OPPOSITE SIDES THEREOF

CROSS-REFERENCE

This is related to U.S. patent application Ser. No. 10/787,661, filed on Feb. 25, 2004 now U.S. Pat. No. 6,991,487 and entitled "CABLE CONNECTOR ASSEMBLY HAVING LOCKING MEMBER" which have the same applicant and assignee as the present invention.

BACKGROUND OF THE INVENTION

1. Field of the Invention

The present invention relates to a cable assembly, and particularly to a cable assembly having a locking member for locking with a complementary connector.

2. Description of Prior Arts

There exists in the art a cable assembly known as a Serial Advanced Technology Attachment (Serial ATA) connector which is generally used for disk drives and storage peripherals. Especially, the Serial ATA connectors according to the Serial ATA standard are featured in fewer counts of electrical contacts than other conventional electrical connectors and are relatively tiny in configuration. It is desirable for the Serial ATA connector to have latch means for providing a reliable mechanical and electrical connection with a complementary connector.

With the development of the Serial ATA standard, the next-generation serial storage interface effort expands the base Serial ATA 1.0 capabilities to address additional markets segments, including the server and networked storage markets. A cable assembly based on Serial ATA II standard is designed to connect with more devices and cables. As the connector is probably applied to a wider profile, an improved locking member of the Serial ATA connector is disclosed (U.S. patent application Ser. No. 10/787,661).

Obviously, it is desirable to improve the structure for retaining the improved locking member on a right angle electrical connector.

SUMMARY OF THE INVENTION

An object of the present invention is to provide a cable assembly having an improved locking member for locking the cable assembly with a complementary connector.

To achieve the above object, a cable assembly mating with a complementary connector along a front-to-back direction comprises an insulative housing, a plurality of contacts disposed in the housing, a plurality of downwardly extending cables including a plurality of conductors connected to a rear portion of the housing, a pair of covers and a pair of locking member; the housing defines a forwardly extending mating port with a pair of opposite side portions, each of said side portions defines a first retention cavity; the cover comprises a front and a rear covers assembled on the housing along the front-to-back direction, and enclosing front portions of the cables together, and defines a pair of opposite side portions with a pair of downwardly extending second retention cavities therein, respectively, the first retention cavities aligned with the corresponding second retention cavities in a up-to-down direction perpendicular to the front-to-back direction. The locking member comprises a cover retention section received in the second retention cavities of the covers, and a housing retention section extending into the first retention cavities of the housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
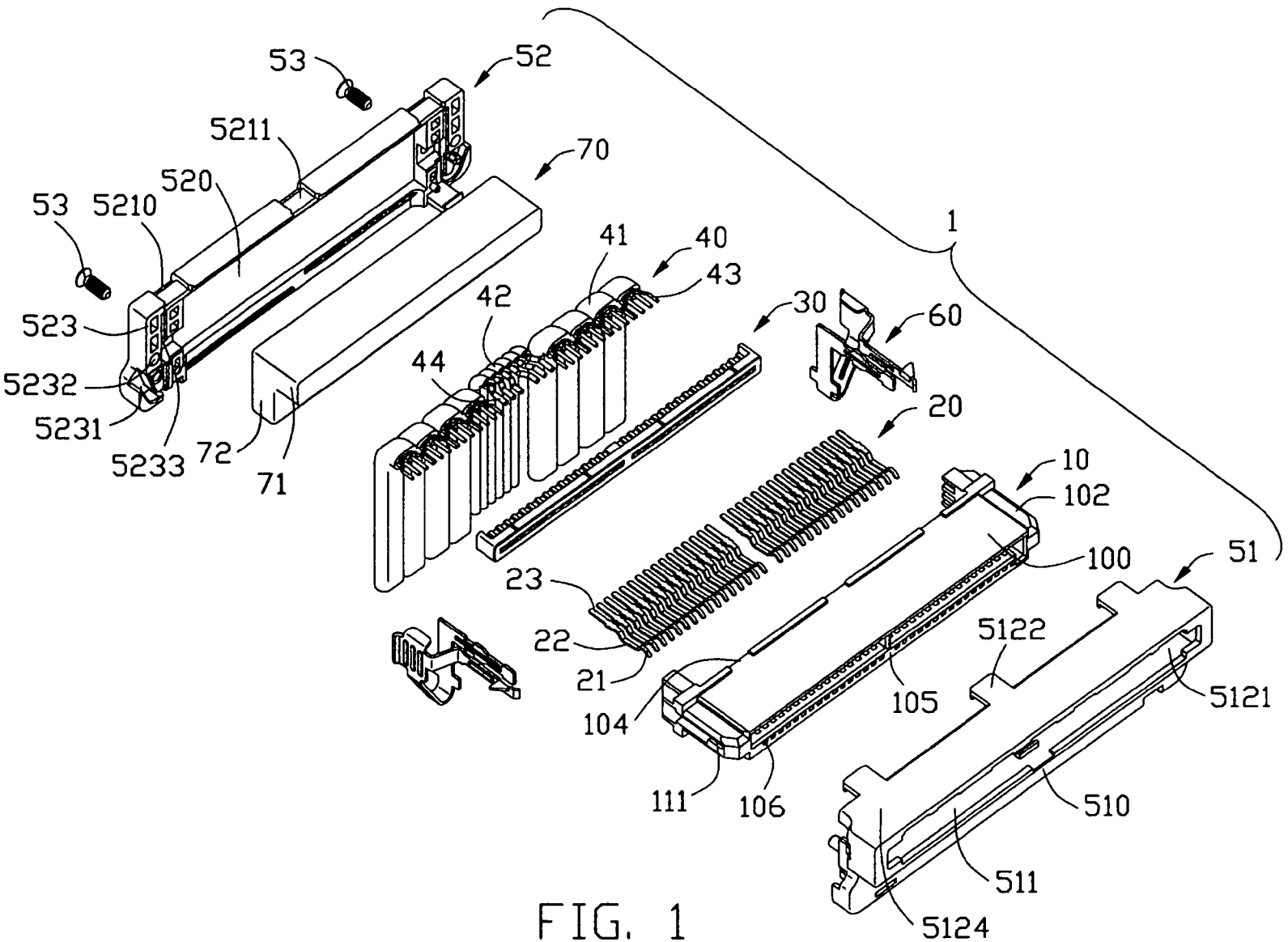
FIG. 1 is an exploded, perspective view of a cable assembly in accordance with the present invention.

Referring to FIGS. 1 to 4, a cable assembly 1 mating with a complementary connector along a front-to-back direction in accordance with the present invention comprises an insulative housing 10, a plurality of contacts 20, a spacer 30, a plurality of cables 40, a cover 50 and a pair of locking members 60. In the present invention, the cable assembly 1 is in accordance with a Serial ATA II standard. However, in alternative embodiments, the electrical connector could be provided as other types.

Figure 2:
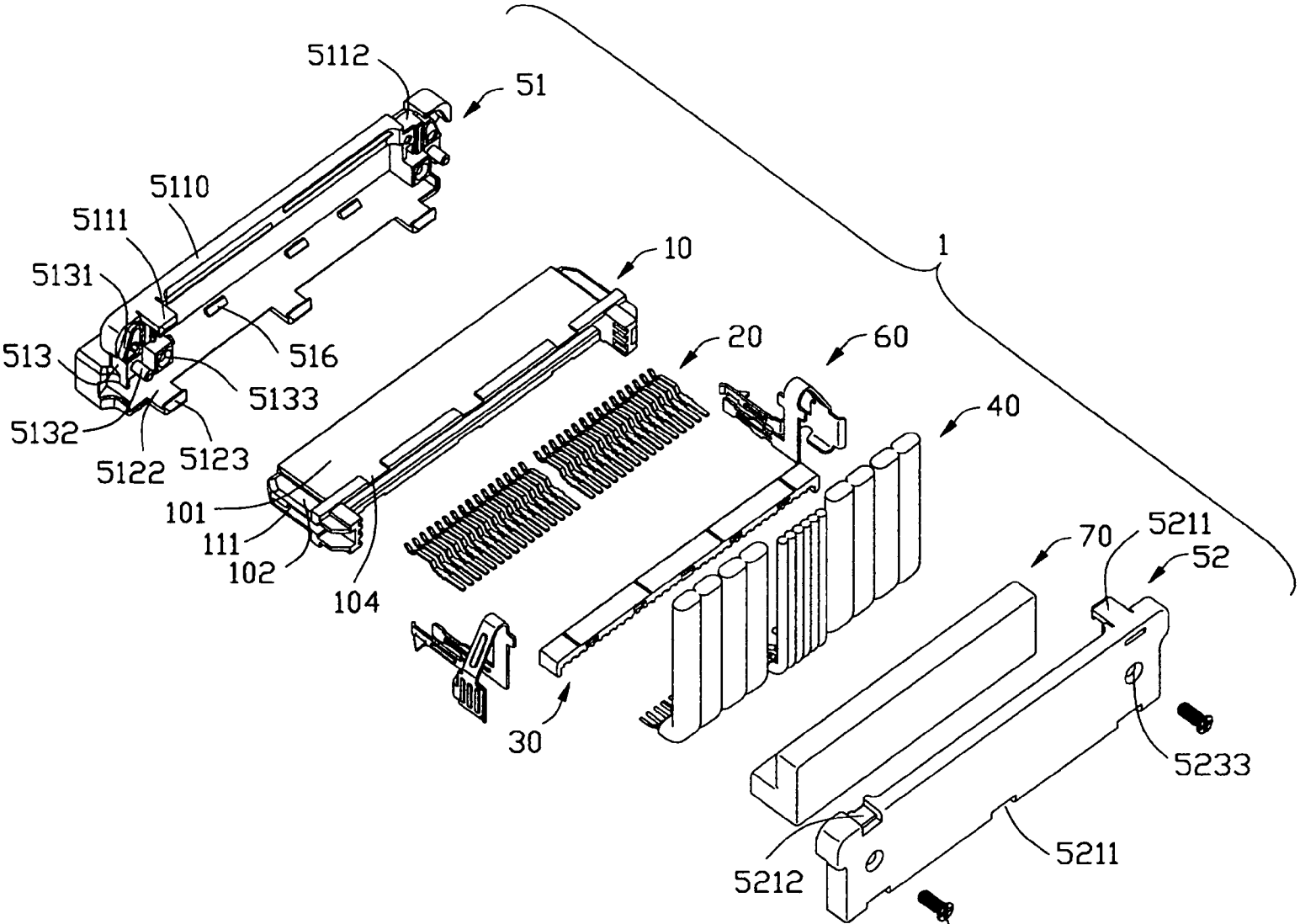
FIG. 2 is an exploded, perspective view similar to FIG. 1, but taken from a different aspect.
Figure 3:
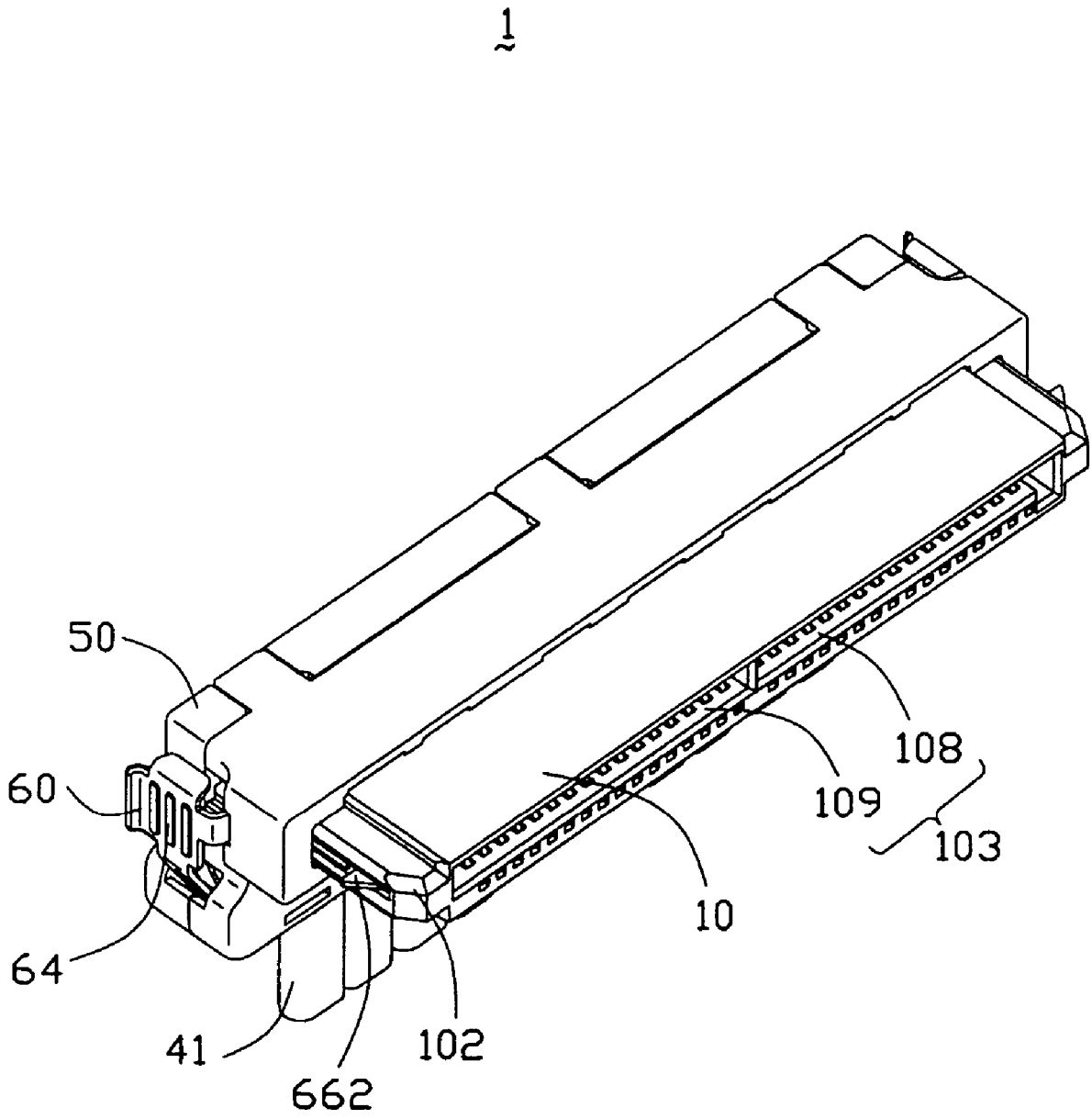
FIG. 3 is an assembled, perspective view of the cable connector assembly of FIG. 1.
Figure 4:
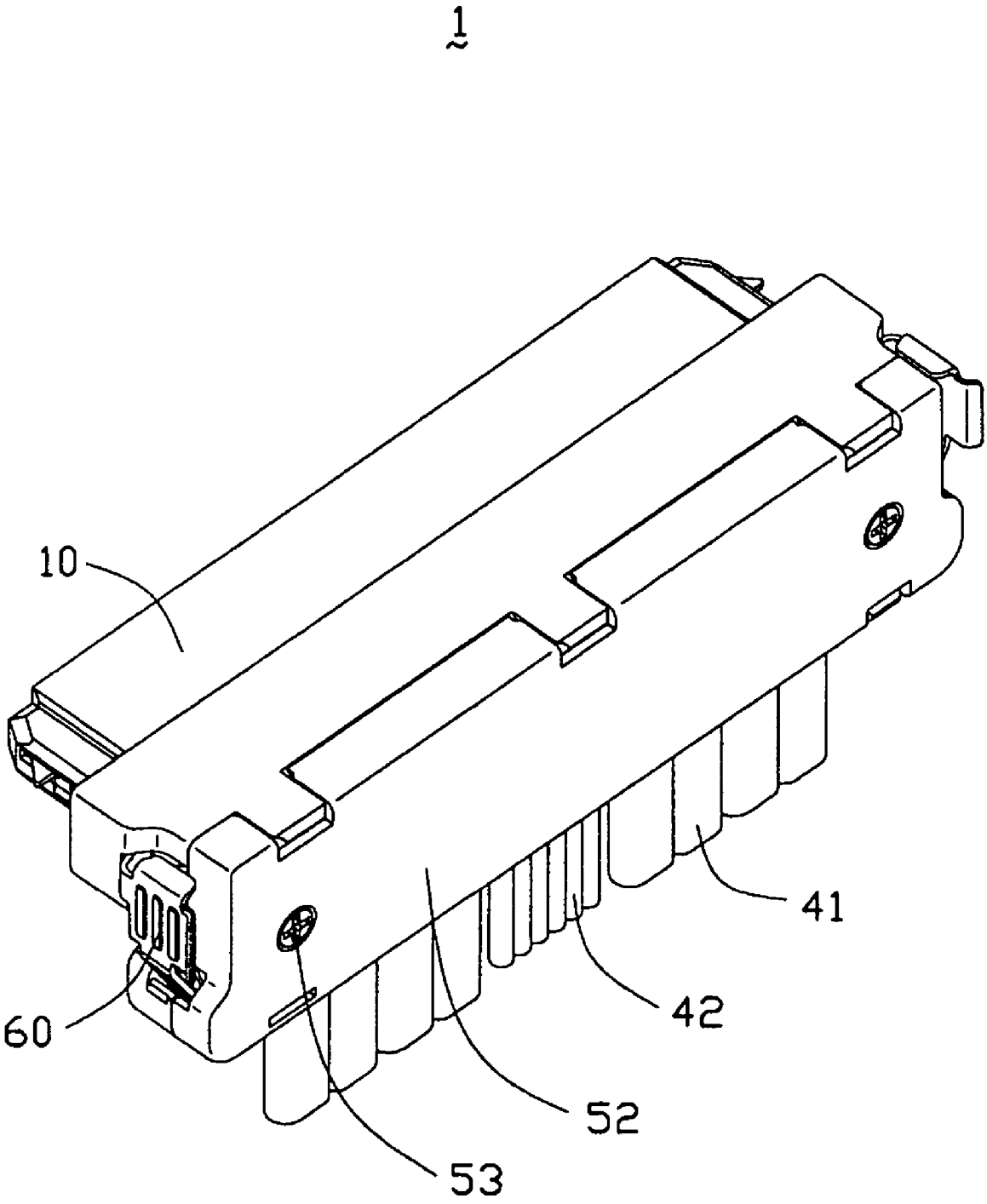
FIG. 4 is a view similar to FIG. 3, but taken from a different aspect.
Figure 5:
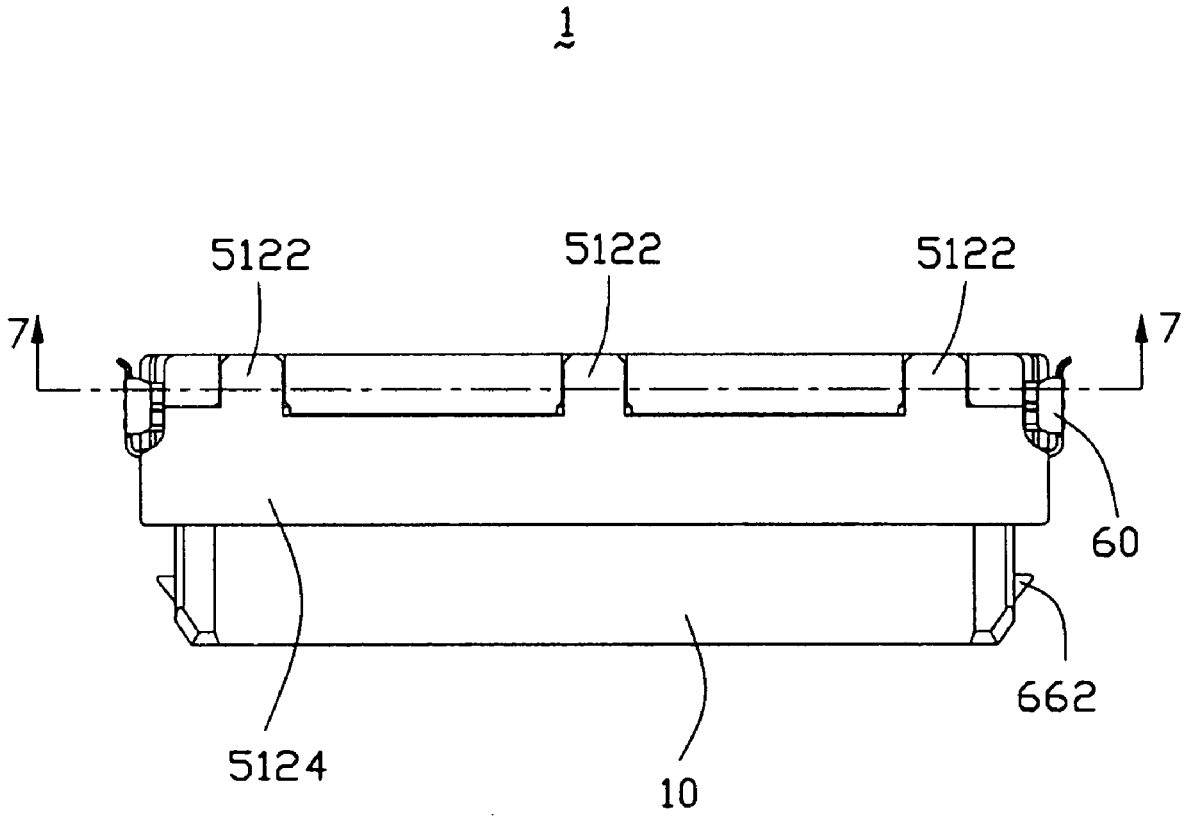
FIG. 5 is a top elevation view of the cable assembly.
Figure 6:
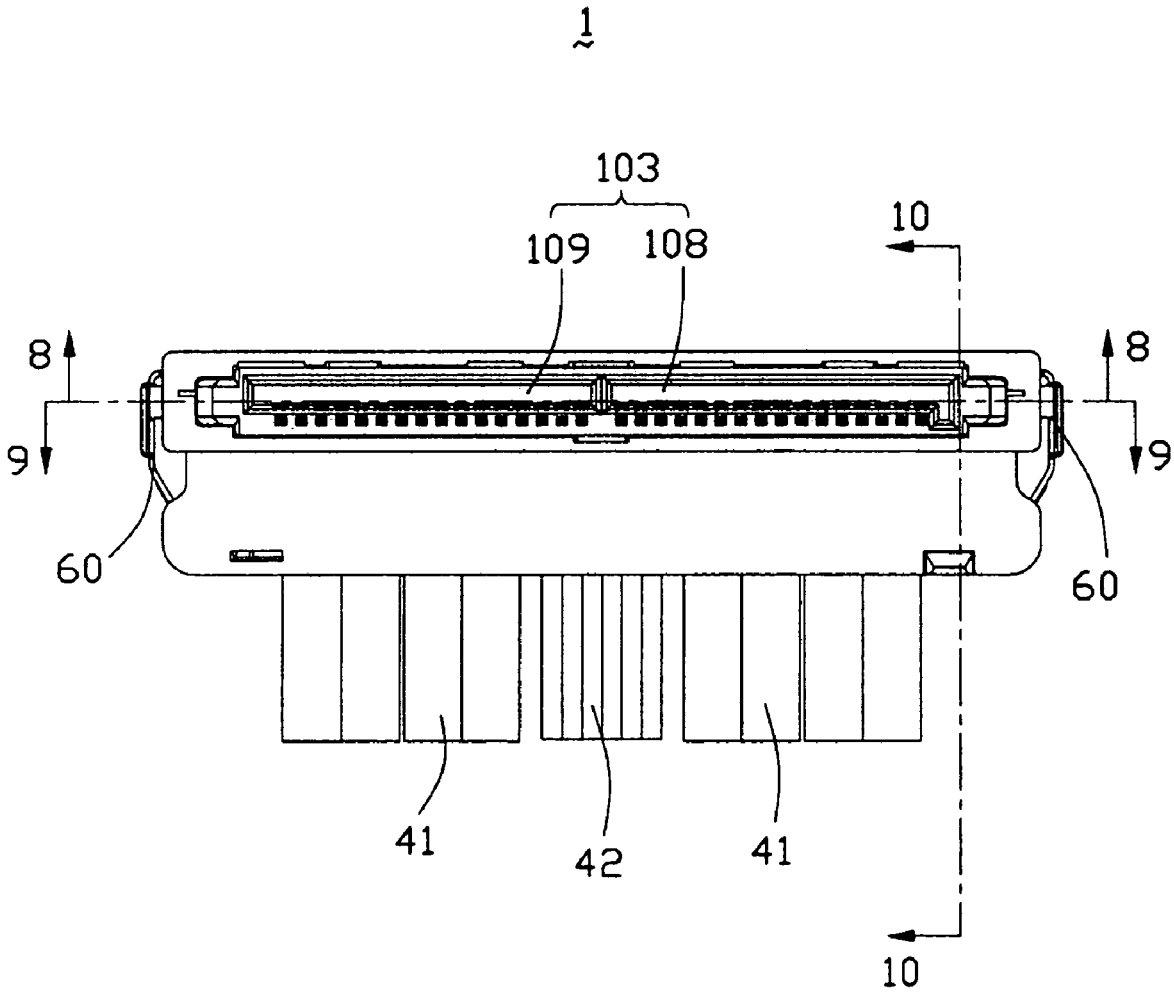
FIG. 6 is a front elevation view of the cable assembly.

Particularly referring to FIGS. 1 and 2, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a front plug receiving space 103 and a rear spacer receiving space (not shown) for respectively receiving a complementary connector (not shown) and the spacer 30. A block 105 is formed with the lower wall 101 and protrudes into the plug receiving space 103. The block 105 defines a plurality of passageways 106 extending therethrough and communicating with the plug receiving space 103 and the spacer receiving space. The plug receiving space 103 is divided into an L-shaped first port 108 and a rectangular second port 109 by a vertically extended partition wall (not labeled) for receiving complementary connectors with different profiles. Each side portion 102 defines a first retention cavity 111 recess inwardly from outer side surface thereof for engaging with the locking member 60. The insulative housing 10 further defines a plurality of cutouts 104 on the upper and bottom faces adjacent to a rear face thereof.

Referring to FIGS. 1 and 2, the contacts 20 are received in the passageways 106 of the insulative housing 10 and each contact comprises a contact portion 21, a tail portion 23 and a housing retaining portion 22 connecting the contact portion 21 and the tail portion 23. The contact portions 21 extend into the L-shaped first port 108 and the rectangular second port 109 of the plug receiving space 103 of the housing 10, respectively. The housing retaining portions 23 are secured within the passageways 106 of the housing 10 by an interference fit. The spacer 30 is mounted to seal a rear end of the insulative housing 10, and comprises a plurality of through holes 31 recessed rearward from a front surface thereof for allowing the tail portions 21 of the contacts 20 extending therethrough. The spacer 30 can prevent plastic material from entering into the passageways 106 of the insulative housing 10 when molding an insulator 70. The contacts 20 and the spacer 30 can be integrally formed before mounting to the insulative housing 10, if desired.

The cables 40 comprise two pairs of first 4-lane cables 41 and a group of second flat ribbon cables 42 located between the two pairs of first cables 41. The second cables 42 are divided into two groups. The first cables 41 and the second cables 42 are respectively designed to transit high-speed signal and low-speed side-band signal. Each cable 40 comprises a plurality of conductors 43, 44 exposed outside and extending towards the spacer 30 for being soldered to corresponding tail portions 22 of the contacts 20.

The insulator 70 is over-molded to enclose the cables 40 and enclosed by the cover 50, and comprises a base portion 71 and a distal portion 72 extending downwardly from the base portion 71 to present the insulator 70 L-shape. The cable 40 extends into the insulator 70 from the distal portion 72 along an up-to-down direction perpendicular to the front-to-back direction and the conductors 43, 44 of the cables 40 extend out of the insulator 70 along the front-to-back direction.

Referring to FIGS. 1, 2, and 7-9, the cover 50 comprises a front cover 51 and a rear cover 52. The front cover 51 is of L-shape and comprises a body portion 510 substantially located in a vertical surface, a forwardly extending mating frame 511 perpendicularly extending from the body portion 510, and a pair of side portions 513 at the opposite ends of the body portion 510. The mating frame 511 defines a rectangle frame 5121, a plurality of plastic latches 5122 extending rearwardly from a top face 5124 of the rectangle frame 5121. Each plastic latch 5122 defines a hook 5123 at the distal end thereof. In the inner face of the rectangle frame 5121, a plurality of projections 516 are disposed alternatively corresponding to the cutouts 104 of the housing 10. Each side portion 513 comprises a U-shape receiving cavity 5131, a positioning post 5132 located above receiving cavity 5131 and a screw-hole 5133 located beside the positioning post 5132. At the bottom of the body portion 511, a block 5111 and a channel 5112 are defined. The rear cover 52 comprises a body portion 520 and a pair of side portions 523 at the opposite ends of the body portion 520. Each side portion 523 defines a U-shaped receiving cavity 5231, a positioning hole 5232 located above receiving cavity 5232, and a screw-hole 5233 located beside the positioning hole 5232. The body portion 520 defines a plurality of retaining channels 5211, a block 5212 corresponding to channel 5112 with a stepped forward end on the front cover, and a channel 5213 corresponding to the block 5111 on the front cover 51. Each retaining channel 5211 comprises a step portion 5210 at a rear end thereof. The retaining channel 5211 is used to receive corresponding plastic latch 5122 with the hook 5123 engaging with step portion 5210.

The front and the rear covers 51, 52 assembled together along the front-to-back direction, the U-shape receiving cavities 5131, 5231 are combined together to form a second receiving cavity 55. The positioning posts 5132 are inserted into the positioning holes 5232 for position. The screw-holes 5133, 5233 are aligned with one another to form a pair of screw-passageways (not labeled), and used to let a pair of screws 53 go through for retaining the cover 51, 52 together.

Figure 10:
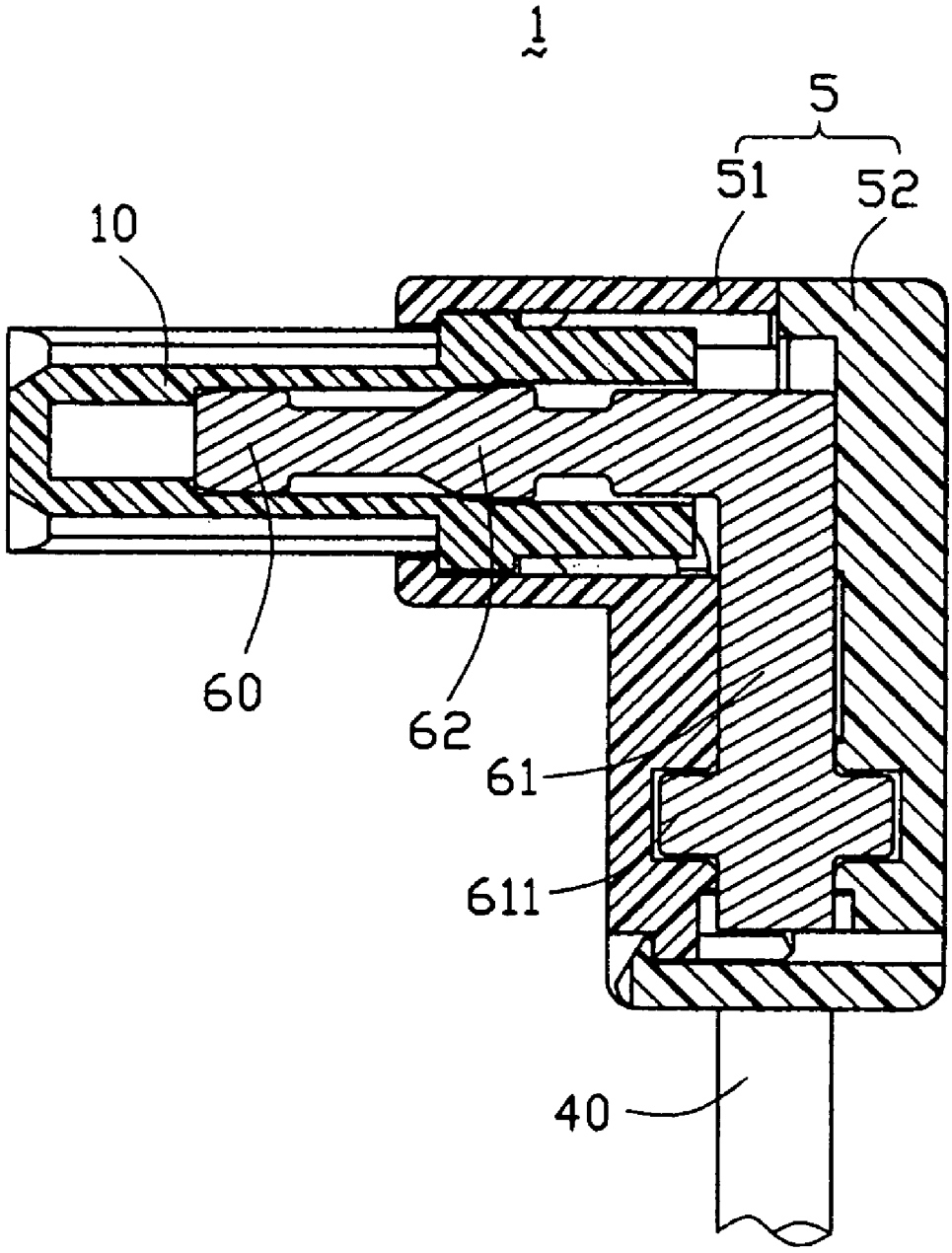
FIG. 10 is a cross-sectional view taken along line 10-10 of FIG. 6.
Figure 11:
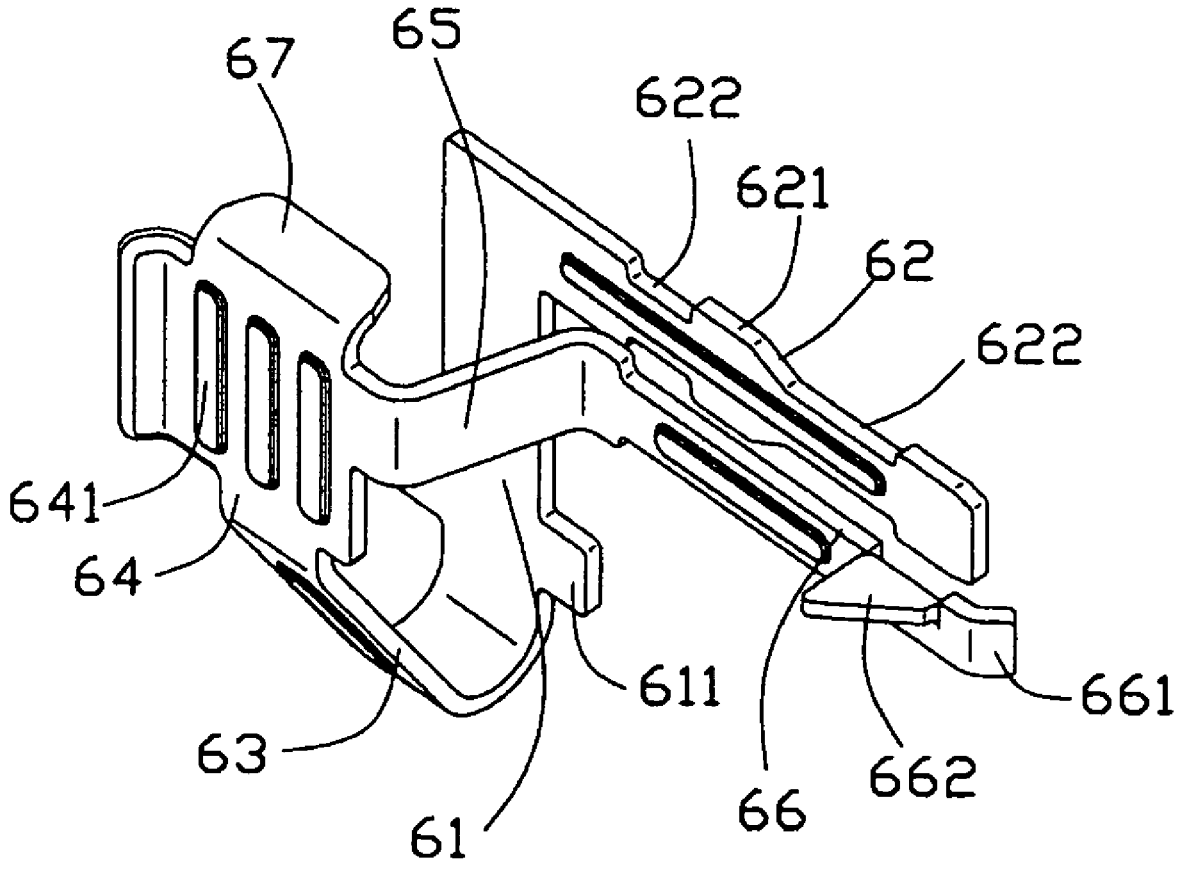
FIG. 11 is an enlarged view of a locking member shown in FIG. 1.
Figure 12:
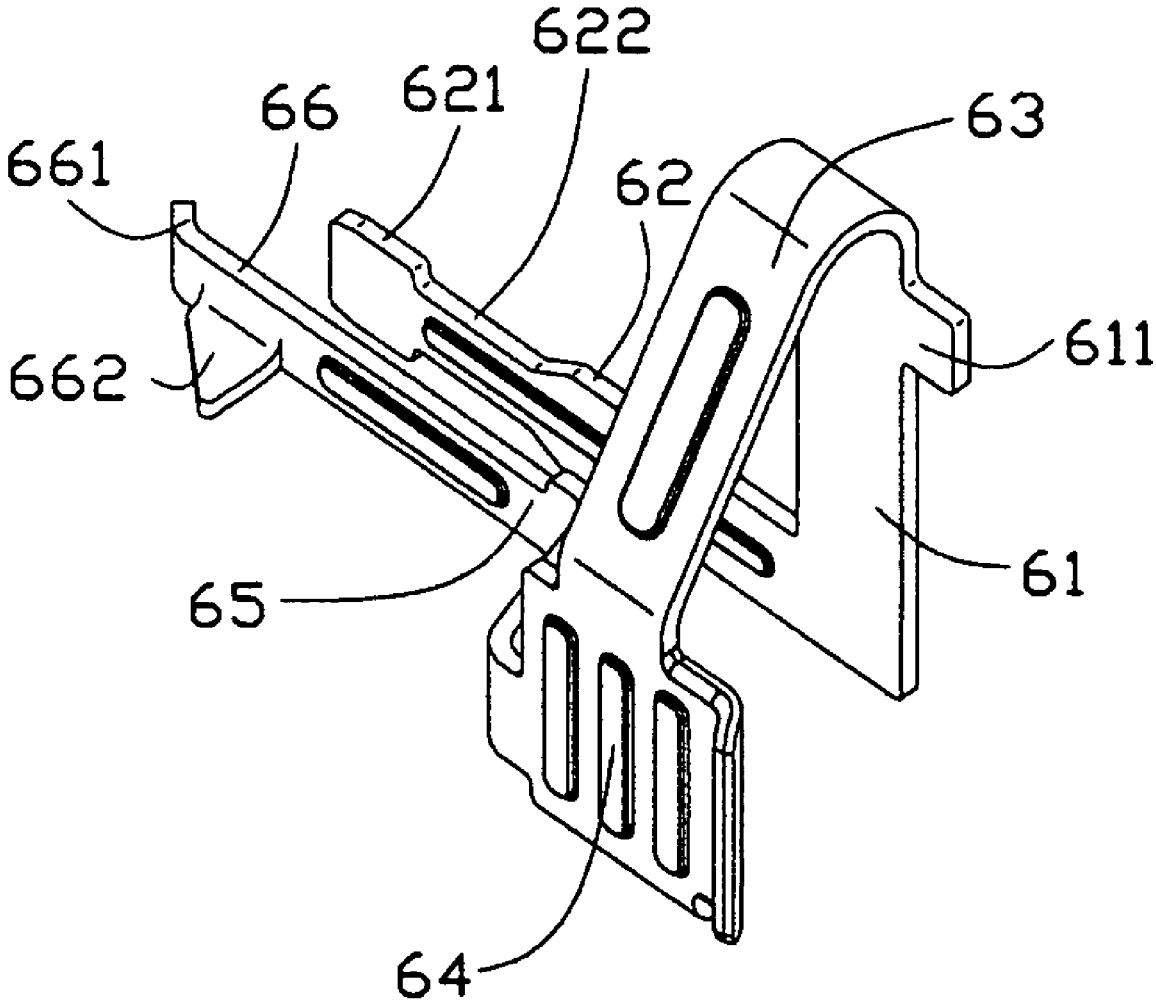
FIG. 12 is a view similar to FIG. 11, but taken from a different aspect.

Referring to FIGS. 10 and 11, each locking member 60 is stamped and formed from a metallic plate and comprises an elongate housing retention section 62 extending along the front-to-back direction, a cover retention section 61 extending downwardly from the housing retention section 62 along the up-to-down direction perpendicular to the front-to-back direction, a spring section 63 extending upwardly and slantways from the cover retention section 61, a flat pushing section 64 extending upwardly from the spring section 63 and run parallel with the housing retention section 61 along the front-to-back direction, an L-shaped positioning section 65 extending forwardly from the pushing section 64, and a latch section 66 extending forwardly from the positioning section 65. The housing retention section 62 is partially cut to form two pairs of recesses 622, thus, also forms a pair of retention tabs 621 at middle and a tip end thereof. The cover retention section 61 defines a pair of retention tabs 611 extending from opposite edges thereof for engaging with the cover 50. The pushing section 64 defines a plurality of protrusions 641 on an outer surface thereof for handling concentrically. A stopping section 67 extends towards the cover retention section 61 from upper edge of the pushing section 64. The latch section 66 comprises a protrusion 661 slantways extending toward the housing retention section 62 and a locking tab 662 bent and extending outwardly.

Figure 7:
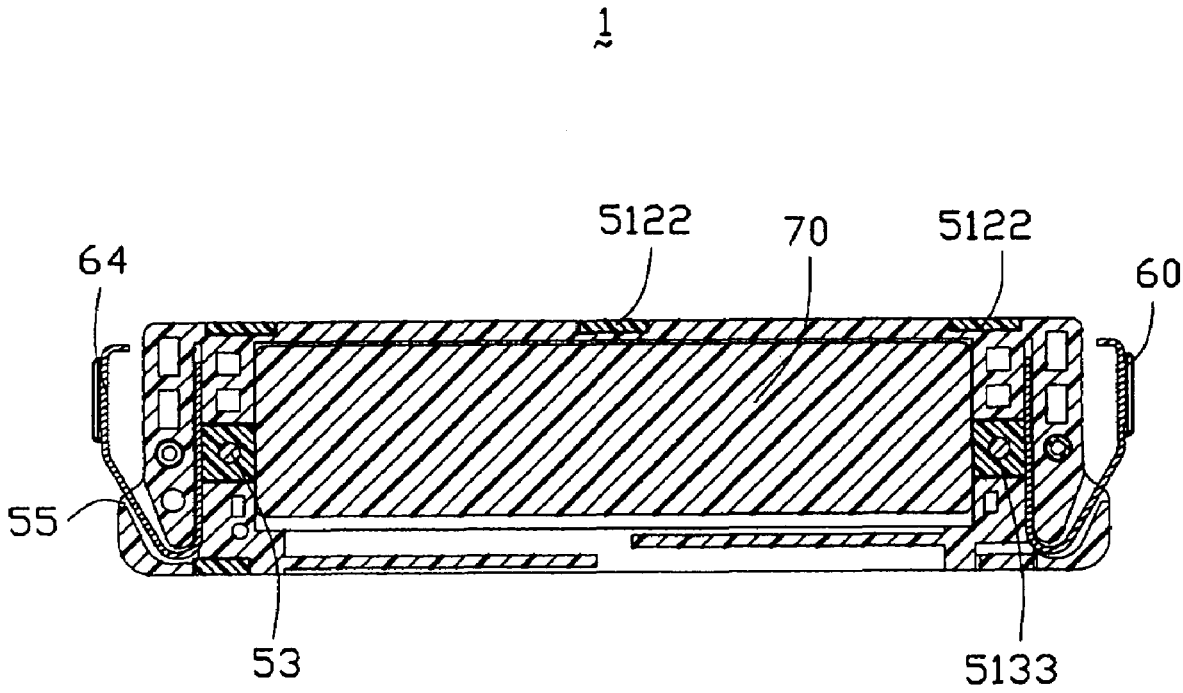
FIG. 7 is a cross-sectional view taken along line 7-7 of FIG. 5.
Figure 8:
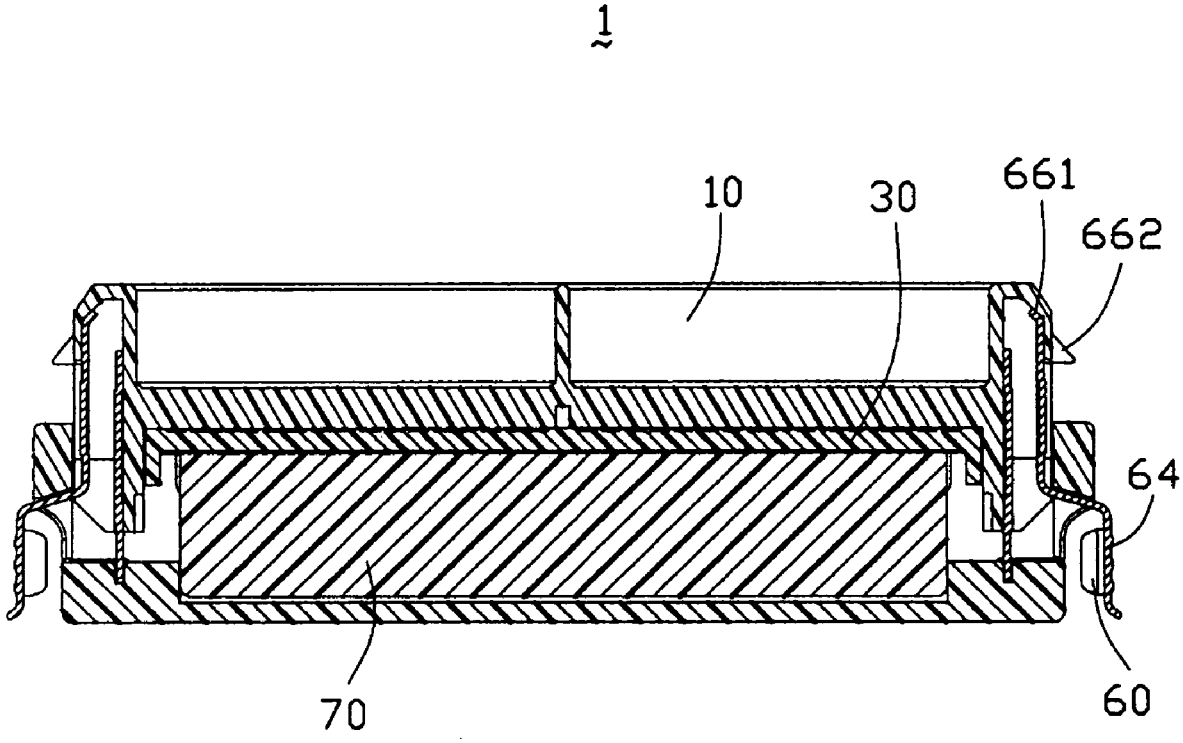
FIG. 8 is a cross-sectional view taken along line 8-8 of FIG. 4.
Figure 9:
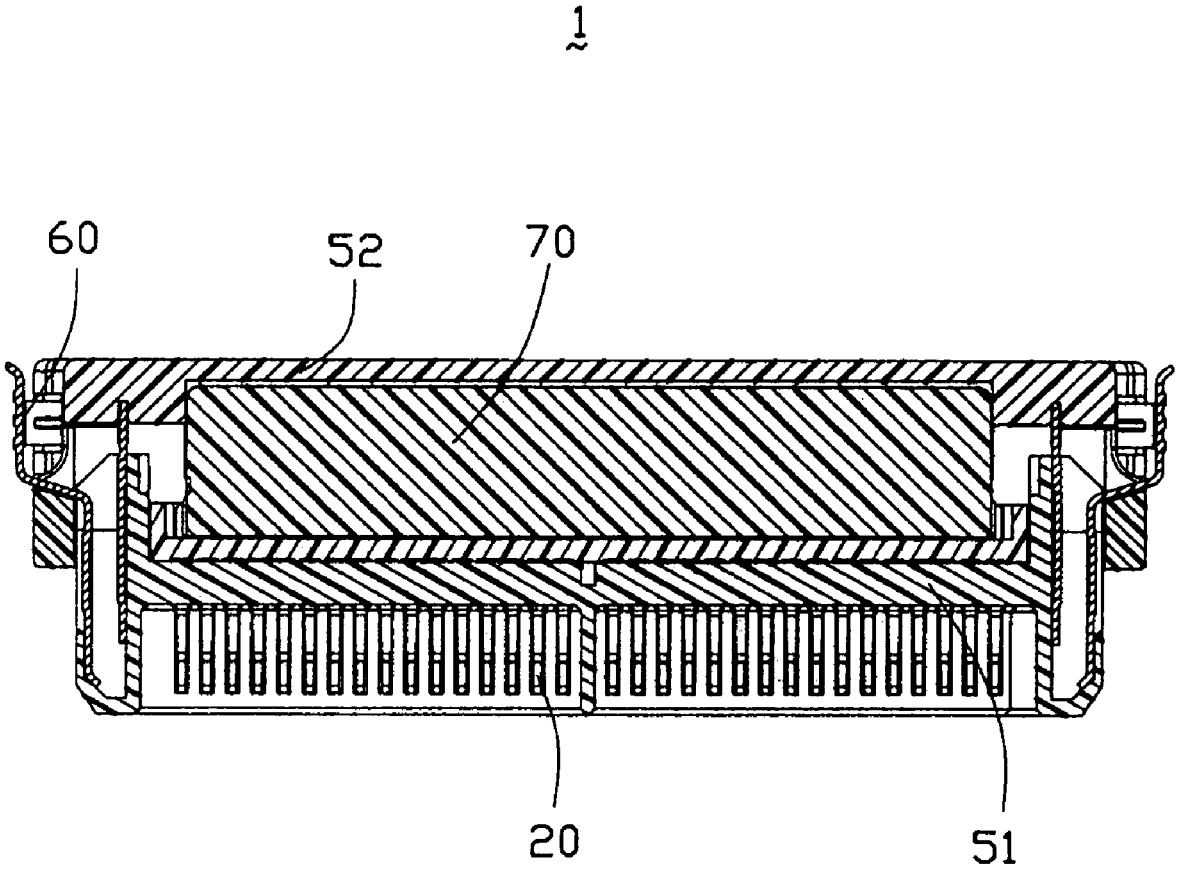
FIG. 9 is a cross-sectional view taken along line 9-9 of FIG. 6.

Referring to FIGS. 7 to 9, in assembly, the housing retention section 62 of the locking member 60 is received in the first retention cavity 111 of the housing 10 with the retention tabs 621 being engaged therein. The cover retention section 61 received in the second retention cavity 55 of the cover 50 with the retention tabs 61 extending to and securely retained in the cover 50. The pushing section 64 and the stopping section 67 are located in the depression (not labeled) of the cover 50, and the stopping section 67 extends towards the cover 50 for preventing the locking member 60 to be bent too more. The latch section 66 is received in the first retention cavity 111 of the housing 10 and the locking tab 662 projects outside the housing 10. The front cover 51 is assembled on the housing 10 along the front-to-back direction with the housing 10 passing through the mating frame 511, and the projections 516 are inserted into the cutouts 104 on the housing 10 to avoid the housing 10 moving backwardly. When the cable assembly 1 mates with the complementary connector, an inward pressing force is firstly exerted on the pushing sections 64 of the locking members 60 by user's fingers to drive the latch section 66 to move inwardly. Once the pressing force is released, the latch section 66 restore to its original position due to their own elasticity, and thus, locks with the complementary connector through the locking tab 622. The positioning tabs 651 of the positioning section 65 abut against the housing 10 for assuring a reliable mating between the cable assembly 1 and the complementary connector. When the cable assembly 1 is to be disengaged from the complementary connector, a contrary operating procedure is applied.

Figure 13:
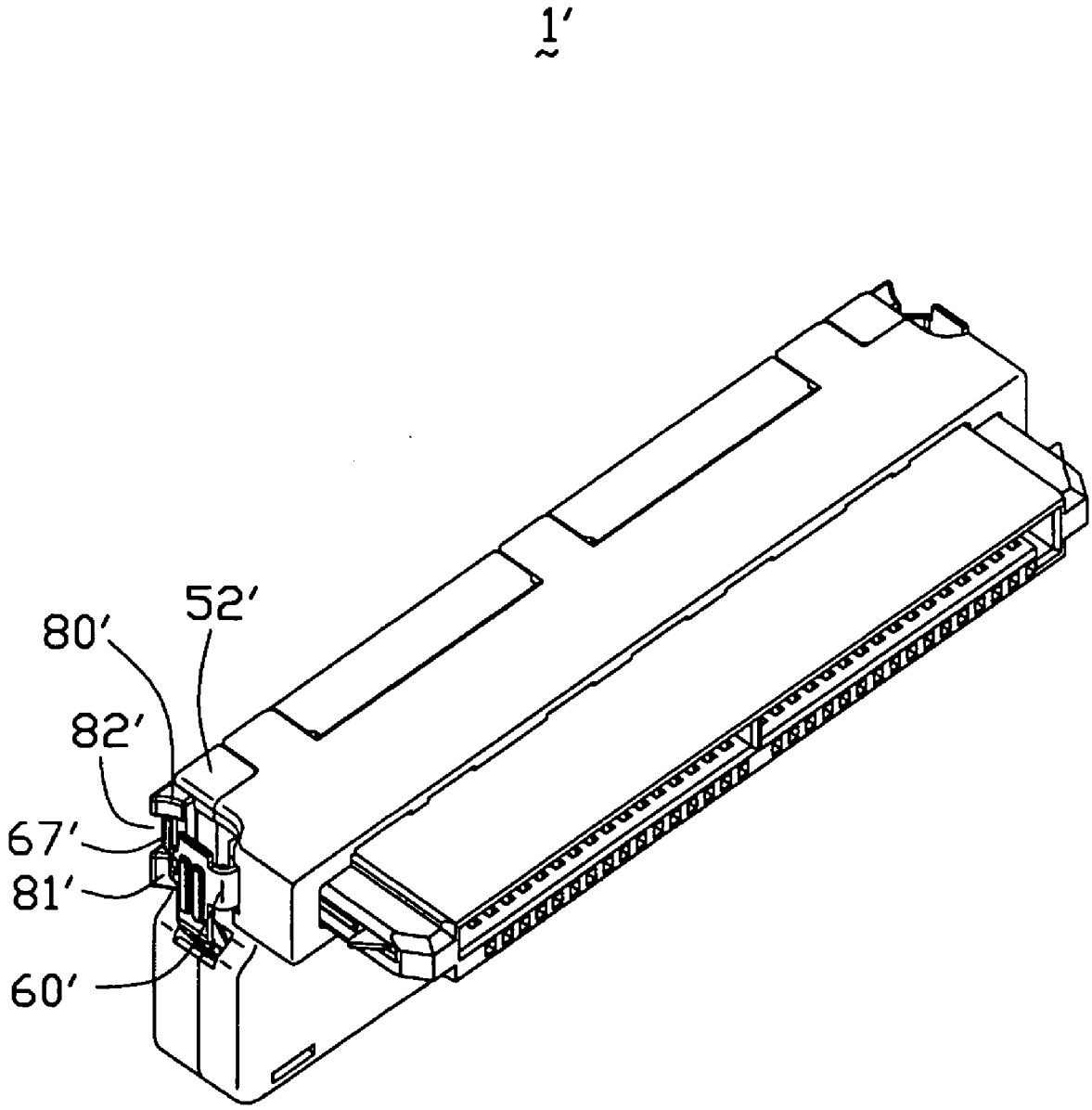
FIG. 13 is an assembled, perspective view of the cable connector assembly of another embodiment.
Figure 14:
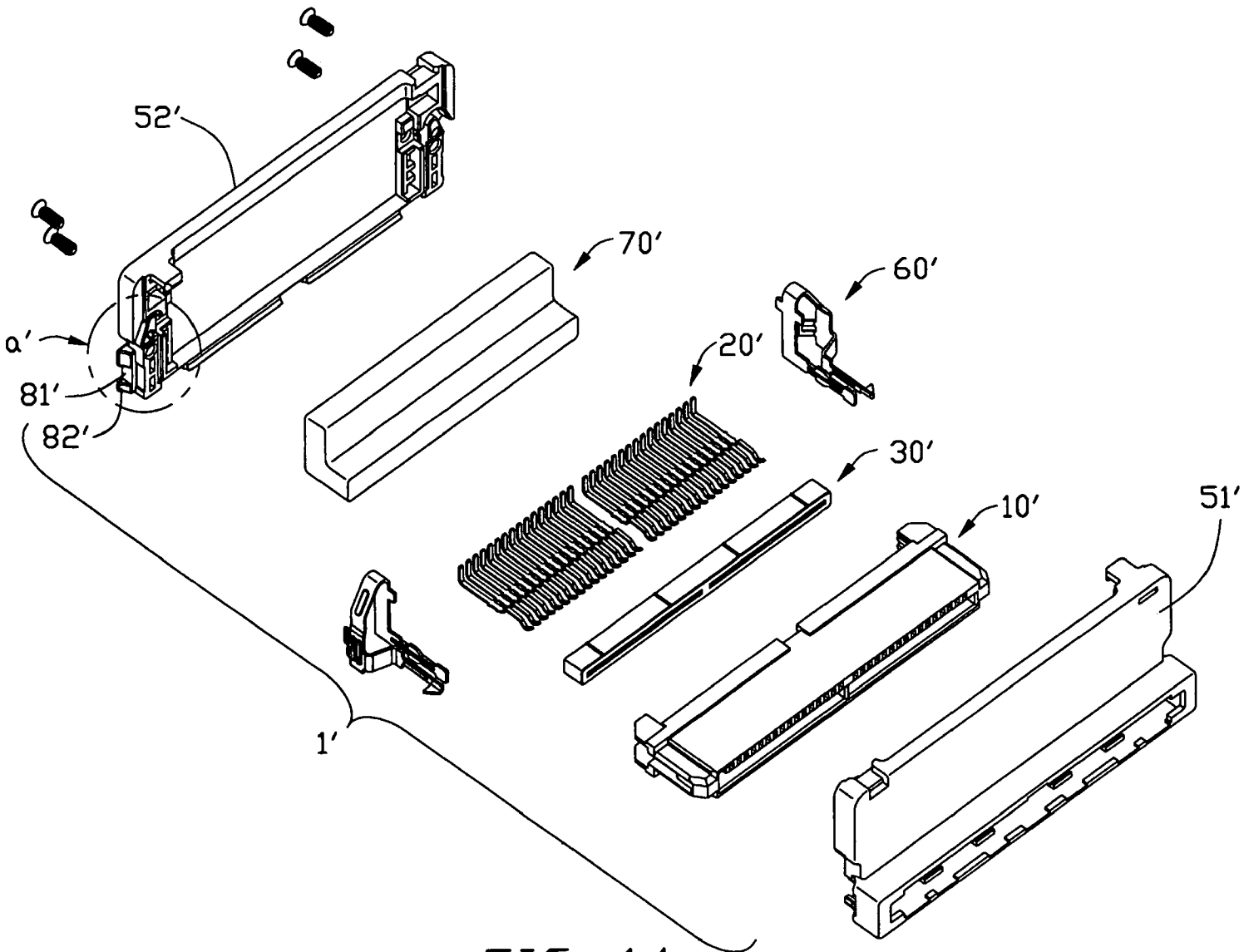
FIG. 14 is an exploded, perspective view of a cable assembly shown in FIG. 13.
Figure 15:
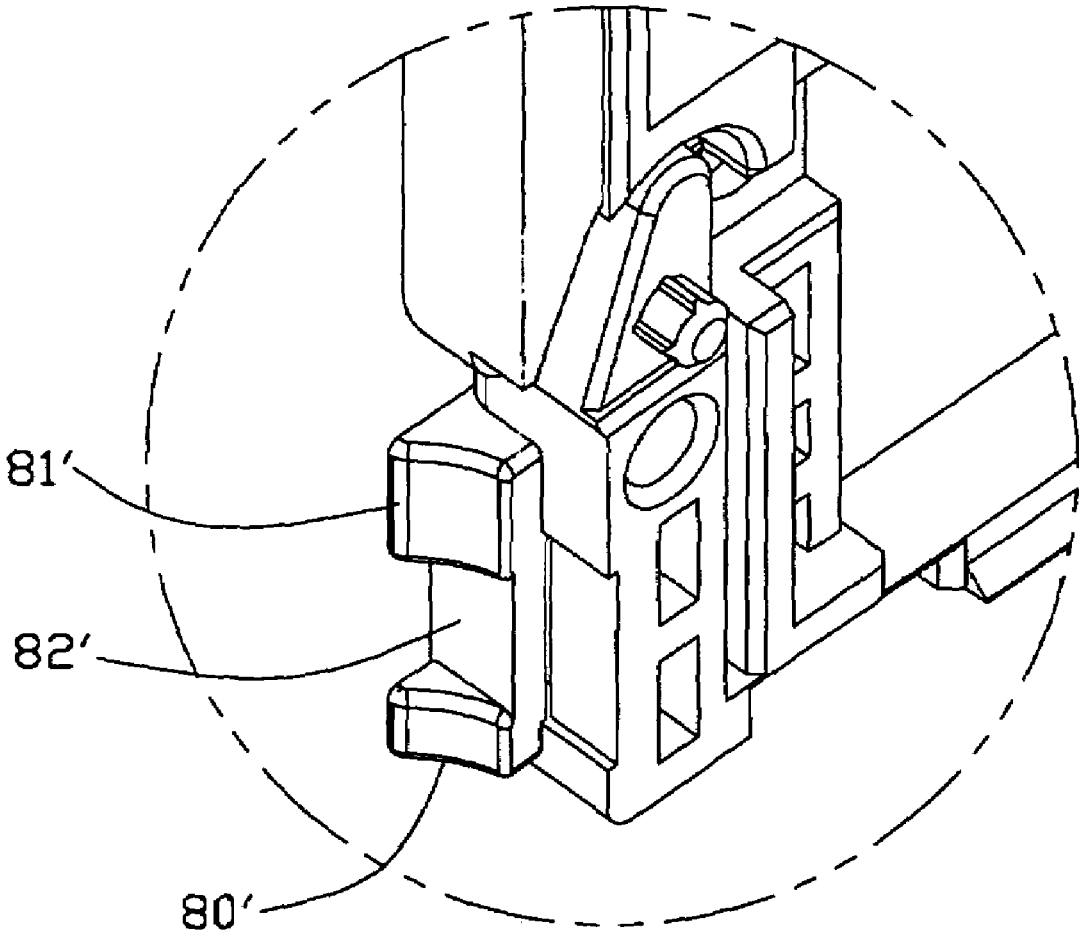
FIG. 15 is an enlarged view of a labeled in FIG. 14.

In another embodiment shown in FIGS. 13-15, the cable assembly 1' further defines a preventing portion 80' at opposite ends of the rear cover 52' thereof. Each preventing portion 80' comprises a pair of arc-projections 81' and a slit 82' between. When a person presses the locking member 60', the finger of the person can not press further deeply because of the existing of the arc-projections 81', and the slit 82' is applied to receive the stopping section 67' of the locking member 60'. Thereby, it avoids the locking member 60' broken cause of an overage pressure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly mating with a complementary connector along a front-to-back direction, comprising:

an insulative housing defining a forwardly extending mating port with a pair of opposite side portions, each of said side portions defining a first retention cavity;

a plurality of contacts disposed in the housing;

a plurality of downwardly extending cables including a plurality of conductors connected to a rear portion of the housing;

a front and a rear covers assembled to the housing along the front-to-back direction, and enclosing front portions of the cables together, and defining a pair of opposite side portions with a pair of downwardly extending second retention cavities therein, respectively, the first retention cavities aligned with the corresponding second retention cavities in a up-to-down direction perpendicular to the front-to-back direction; and a pair of locking members comprising a cover retention section received in the second retention cavities of the covers, and a housing retention section extending into the first retention cavities of the housing.

2. The cable assembly as described in claim 1, wherein the cover retention section is at the same plane with and perpendicular to the housing retention section.

3. The cable assembly as described in claim 1, further comprising an insulator insert-molded with the cables and received in the covers.

4. The cable assembly as described in claim 3, wherein the cables extend along the up-to-down direction first, and then extend along the front-to-back direction.

5. The cable assembly as described in claim 1, wherein the front cover comprises a body portion and a mating frame above the body portion, said side portions are defined at the opposite sides of the body portion, the rear cover comprises a body portion, said side portions are defined at the opposite ends of the body portions.

6. The cable assembly as described in claim 5, wherein the front cover defines a latch extending rear rearwardly from the mating frame with a hook formed at the distal end thereof, the rear cover defines a retaining channel corresponding to the position of latch, each retaining channel defines a step portion, and said latch is received in the retaining channel with the hook engaging with the step portion.

7. The cable assembly as described in claim 1, wherein the front cover and the rear cover, respectively, comprises a positioning hole and a positioning post received in the positioning hole for positioning the front and the rear covers.

8. The cable assembly as described in claim 1, wherein the front and the rear cover are retained together by a screw, and the screw is inserted into the cable assembly along the front-to-back direction.

9. The cable assembly as described in claim 8, wherein the front and the rear cover, each comprises a screw-hole, the screw-holes define a screw-passageway for letting the screw go through.

10. The cable assembly as described in claim 1, wherein the locking member further comprises a spring section extending upwardly and slantways from the cover retention section, a flat pushing section extending forwardly from the spring section and run parallel with the housing retention section along the front-to-back direction, a positioning section extending forwardly from the pushing section.

11. The cable assembly as described in claim 10, wherein the stopping section extends toward to the cover for preventing the locking member to be bent too more.

12. The cable assembly as described in claim 1, wherein the cables comprise at least a first cable and at least a second cable transmitting different types of signals.

13. The cable assembly as described in claim 1, further comprises a spacer mounted on a rear end of the housing.

14. The cable assembly as described in claim 1, wherein the housing defines a receiving space therein and a partition wall extending along a longitudinal direction, the receiving space is divided by the partition wall into two ports.

15. The cable assembly as described in claim 14, wherein one of the two ports of the housing is L-shaped.

16. The cable assembly as described in claim 1, wherein the cover defines a preventing portion at opposite end of the rear cover thereof.

17. The cable assembly as described in claim 16, wherein each preventing portion comprises a pair of arc-projections and a slit between.

18. A cable connector assembly comprising:

an insulative housing defining a mating port;

a plurality of contacts disposed in the housing and exposed to the mating port;

a plurality of wires having thereof front portions connected to a rear portion of the housing and electrically connected to the corresponding contacts respectively;

a casing enclosing the rear portion of the housing and the front portions of the wires, said casing being of an L-shaped; and at least one movable latch held by the casing and defining an L-shaped configuration with thereof a horizontal section having locking means thereon close to the mating port, and a vertical section having an operation section accessible from an exterior.

19. A cable connector assembly comprising:

an insulative housing with a horizontal mating port;

a plurality of contacts disposed in the housing and exposed to the mating port;

a plurality of wires extending rearward from the housing in an L-shaped manner;

at least one latch positioned by one side of the housing and defining a horizontal section with locking means thereon moveable around the mating port, and an operation section angled with the horizontal section from a side view, and located on an outer side with regard to the horizontal section.

20. The assembly as claimed in claim 19, wherein said both said horizontal section and said operation section are moved along a same direction when actuated.

* * * * *